US005501495A

United States Patent [19]

Claucherty

[11] Patent Number: 5,501,495

[45] Date of Patent: Mar. 26, 1996

[54] AUTOMOBILE DOOR STRIKER ASSEMBLY

[75] Inventor: Burrell S. Claucherty, Jackson, Mich.

[73] Assignee: Manchester Stamping Corporation, Manchester, Mich.

[21] Appl. No.: 196,467

[22] Filed: Feb. 15, 1994

[51] Int. Cl.[6] ..... E05B 15/02

[52] U.S. Cl. ..... 292/340; 292/216

[58] Field of Search ..... 292/340, 341, 292/216, 198, 281

[56] References Cited

U.S. PATENT DOCUMENTS 2,661,973 12/1953 Sweger ..... 292/216 X
5,125,698 6/1992 Thau ..... 292/216

FOREIGN PATENT DOCUMENTS 272116 6/1988 European Pat. Off. ..... 292/340
1436996 5/1976 United Kingdom ..... 292/216
1471896 4/1977 United Kingdom ..... 292/281

*Primary Examiner*—Rodney M. Lindsey
*Attorney, Agent, or Firm*—Harness, Dickey & Pierce

[57] ABSTRACT

A striker assembly for an automobile door latching mechanism. The striker assembly is made up of a body constructed from a pair of individually formed rigid members which are fixedly secured to each other. The rigid members each including a mounting flange adapted to mount the assembly to the door pillar or jamb of an automobile. Each rigid member also includes a substantially planar striker plate which is angularly oriented with respect to the mounting plates. The rigid members are secured to each other through the striker plates and a common aperture is defined therethrough. The aperture further defines an integral striker bar that extends along two sides of the striker plates. The striker bar and aperture are thus configured to receive a latch of the automobile door locking mechanism thereby providing a robust construction and ensuring that the automobile door is retained in its closed position.

8 Claims, 1 Drawing Sheet

AUTOMOBILE DOOR STRIKER ASSEMBLY

BACKGROUND OF THE INVENTION

1. Field of the Invention

This invention generally relates to latch assemblies. More particularly, the present invention is directed to a striker assembly as might be used with the latching mechanism of an automobile door.

2. Description of the Related Art

When designing a lock for a vehicle door, it is the primary objective to provide a mechanism which will ensure engagement between the latching mechanism mounted to the door and the striker assembly mounted to the door jamb when the door is closed. In designing these two components, it is also desirable to design the mechanisms such that they are strong enough to substantially withstand a collision and minimize the likelihood of the door opening.

The most common vehicle door latch design uses a striker bar assembly in which a substantially cylindrical shank, bent into a general U-shape, extends from a mounting plate or cover. This shank is often referred to as the striker bar. The striker bar is typically oriented in a horizontal fashion so that it can be readily engaged by the latch or latching pawl of the latching mechanism during the closing of the vehicle door. While the present invention is particularly described for use in latching a vehicle door, it is obvious that the striker assembly of the present invention will find utility in a wide variety of other latching situations.

During closing of the vehicle door, the location of the striker bar causes it to extend within a slot defined within the door. The striker bar engages the pawl of the latching mechanism and encourages the latch to rotate around the striker bar until the pawl engages or hooks around the shaft of the striker bar. This prevents the striker bar from exiting the slot defined in the door and keeps the door closed and latched. Obviously, the construction of the striker assembly should be strong enough to prevent shearing of the striker bar from the striker assembly in the event of most collisions.

It is therefore an object of the present invention to provide a striker assembly for a vehicle door, hood, trunk, or other similar object which is intended to be engaged by a latching mechanism.

A further object of this invention is to provide a striker assembly which, when the door is normally closed, ensures complete engagement between the pawl of the vehicle door latching mechanism and the striker bar of the striker assembly. Another object is to provide a striker assembly that assists in preventing inadvertent and unintentional opening of the vehicle door or other structure.

It is yet another object of this invention to provide a striker assembly whose construction is generally capable of withstanding collision forces so as to avoid the forced opening of the door during most collisions.

It is a further object of this invention to provide a striker assembly which is cost efficient to produce, which has a simplified construction that reduces production costs, and which is capable of adequately functioning to secure a vehicle door latching mechanism.

SUMMARY OF THE INVENTION

In achieving the above objects, the present invention provides a striker assembly particularly adapted for use with an automobile door latching mechanism. The striker assembly generally includes a body constructed from a pair of individually formed elements that are provided with a mounting flange and a striker plate. The mounting flange enables the striker assembly to be mounted to an automobile door pillar. The striker plates are oriented so that they extend from the mounting plates and allow the two individual elements to be secured together. An aperture is commonly defined through the striker plates and the aperture further defines an integrally formed striker bar which extends along two sides of the striker plate. As configured, the striker bar and aperture readily receive the spring biased latching pawl of the automobile door latching mechanism and ensures that the automobile door is positively retained in its closed position.

Additional benefits and advantages of the present invention will become apparent to those skilled in the art to which this invention relates from the subsequent description of the preferred embodiments and the appended claims, taken in conjunction with the accompanying drawings.

DESCRIPTION OF THE PREFERRED EMBODIMENT

Figure 1:
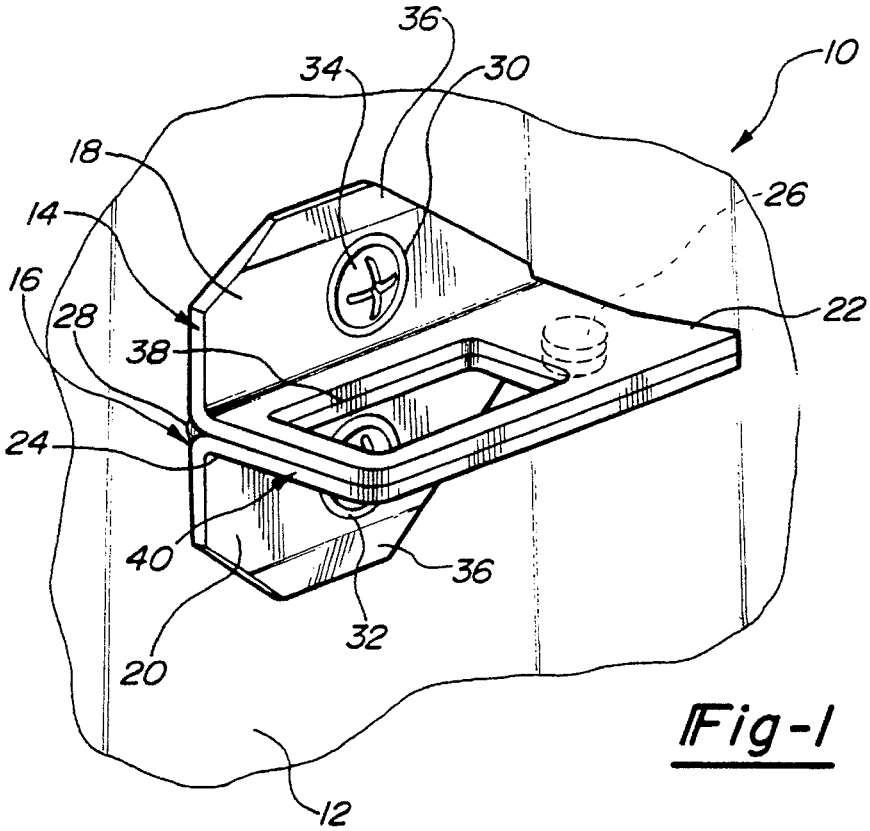
FIG. 1 is a perspective view of a striker assembly constructed according to the principles of the present invention and mounted to the pillar of an automobile.
Figure 2:
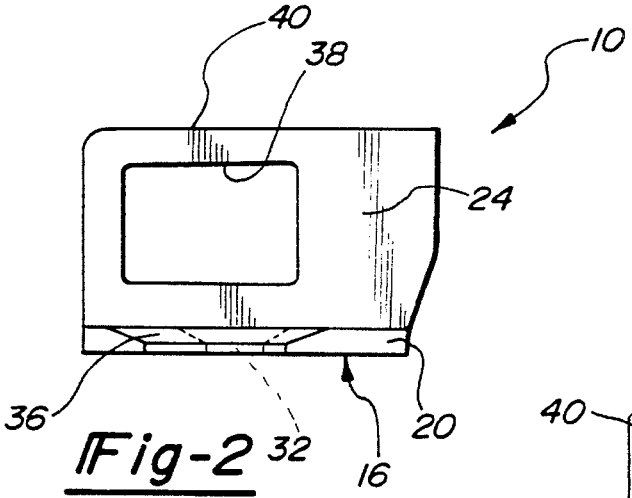
FIG. 2 is a side elevational view of the striker assembly illustrated in FIG. 1.
Figure 3:
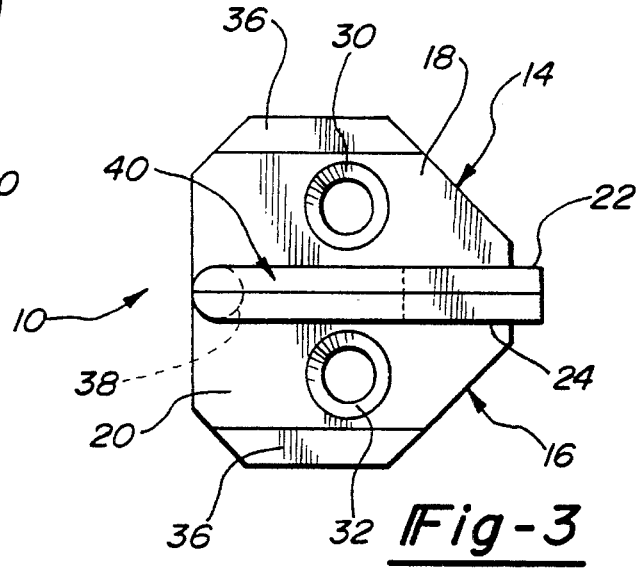
FIG. 3 is a top plan view of the striker assembly as seen in FIGS. 1 and 2.

Referring now to FIG. 1, an automobile or striker assembly embodying the principles of the present invention is generally illustrated therein and designated at 10. As illustrated in FIG. 1, the striker assembly 10 is mounted to a door jamb 12 on the right side of the automobile. The striker assembly 10 is designed to operate with a latching or locking mechanism (not shown) mounted within the vehicle's door. Typically, the locking mechanism includes a pawl or locking lever that is accessible through a slot defined in the door. As the automobile door is closed, the appropriate portion of the striker assembly 10, as further described below, enters the slot and is engaged with the pawl so as to prevent inadvertent opening of the door during operation of the vehicle or during a collision.

As will become apparent from the discussion which follows, the present invention will not only have utility with vehicle doors, but will also have use wherever striker assemblies are employed. Such additional uses include, but are not limited to, vehicle hoods, vehicle trunks, and non-vehicle application. For the sake of clarity, the striker assembly 10 of the present invention is shown in the figures and described only in conjunction with an automobile door.

The striker assembly 10 of the present invention utilizes a robust construction which reduces manufacturing costs while increasing the structural integrity of the assembly 10. As seen in the figures, the striker assembly 10 is constructed by fixedly securing two rigid members together. Hereinafter, these members are referred to as an upper element 14 and a lower element 16. The elements 14 and 16 are formed from a plate metal stock, such as steel, and are bent to form two generally perpendicular portions. These portions of the upper and lower elements 14 and 16 are respectively referred to as mounting plates 18 and 20 and latching plates 22 and 24.

As mentioned above, the upper and lower elements 14 and 16 are fixedly or rigidly secured together. This is achieved in two ways. The first is by spot welding the latching plates 22 and 24 to one another. The spot weld is generally designated at 26. To further ensure that the elements 14 and 16 are rigidly secured to one another, the latching plates 22 and 24 are also brazened, as designated at 28, along the recess generally defined between the elements 14 and 16 at the transition from the mounting plates 18 and 20 to the latching plates 22 and 24. The brazening is by atmosphere brazening in a high temperature brazening furnace which creates a condition that pulls the brazening material between the upper and lower elements 14 and 16 along adjacent, side-by-side interior faces of the latching plates 22 and 24 by capillary action thereby creating a solid joint which fills all the voids between the two elements 14 and 16.

The mounting plates 18 and 20 each include portions which define a beveled aperture 30 and 32 that is configured to receive threaded fasteners, such as sheet metal screws 34. The fasteners 34 securely mount the striker assembly 10 to the vehicle door pillar or jamb 12. To decrease the weight of the assembly 10, the corners of the mounting plates 18 and 20 are angularly cut generally giving the mounting plate a gambrel shape. Alternatively, the mounting plates 18 and 20 may be provided with a rectangular construction. However, this construction would not further enhance the structural integrity of the mounting plates 18 and 20 only adds unnecessary weight to the assembly 10. The horizontal or upper and lower edges 36 of the mounting plates 18 and 20 also exhibit a tapered thickness. The taper further decreases the weight of the assembly 10 and reduces the likelihood of a passenger's garment or bag becoming caught on that portion of the assembly 10.

When mounted to the door jamb 12, the striker assembly 10 is positioned so that the latching plates 22 and 24 are generally horizontally oriented. The assembly 10 is further positioned so that an aperture 38, commonly defined through the two latching plates 22 and 24 and offset to one side thereof, is located generally toward the outboard side of the vehicle and the remainder of the latching plates 22 and 24. The aperture 38 helps to define a striker bar 40 as extending along two sides, the outboard and forward sides, of the latching plates 22 and 24. If desired, the interior and exterior edges of the striker bar 40 can be machined or otherwise rounded to assist in causing the pawl of the latching mechanism to advance over the striker bar 40 and engage the striker assembly 10, particular the interior surfaces of the striker bar 40.

During use, the closing of the vehicle door and the relative positioning of the striker assembly 10 on the door jamb 12 causes the striker bar 40 to enter the door slot which provides access to a latching mechanism of a well known variety. Upon entering the slot, the striker bar 40 engages the lead surface of the spring biased pawl and, upon further closing of the door, causes the pawl to deflect. Once the door completely closes, the pawl is biased back by the spring so that the locking lip or finger of the pawl is positioned behind the striker bar 40 and engages the interior or back surfaces thereof. In this manner the door is retained in its closed position and prevented from inadvertently opening. The pawl of the locking mechanism will remain engaged with the striker assembly 10 until actuated by the door release mechanism (not shown) which causes the pawl to move into a position where it is disengaged from the striker bar 40. The door is then free to open.

While the above description constitutes the preferred embodiments of the present invention it will be appreciated that the invention is susceptible to modification, variation and change without departing from the proper scope and fair meaning of the accompanying claims.

What is claimed is:

1. A striker assembly for an automobile door locking mechanism, said striker assembly comprising:

a body defined by a pair of individually formed rigid members fixedly secured to one another to form said body, said rigid members each being unitary structures including a mounting flange adapted to mount said striker assembly to an automobile door, said rigid members each also including a substantially planar striker plate having an interior face and an exterior face, said mounting flanges being angularly oriented with respect to said striker plates, said interior faces of said striker plates being in surface-to-surface contact with one another and said interior face of one of said striker plates being fixedly secured to said interior face of the other of said striker plates, each of said striker plates having portions defining an aperture commonly extending through both of said striker plates, said aperture being defined in said striker plates so as to be generally offset to one side of said striker plates, said striker plates being secured to each other by a spot weld at an enlarged area resulting from the offset location of said aperture, said aperture further defining an integral striker bar in said striker plates which extends along two sides of said striker plates in opposition to said enlarged area, said striker bar and said aperture being configured to receive a latch of the automobile door locking mechanism thereby retaining the automobile door in its closed position.

2. A striker assembly as set forth in claim 1 further comprising means formed in said mounting flanges for mounting said striker assembly to an automobile door pillar.

3. A striker assembly as set forth in claim 1 wherein said striker plates are secured to one another by welding.

4. A striker assembly as set forth in claim 1 wherein said striker plates are secured to one another by spot welding through said interior faces of said striker plates.

5. A striker assembly as set forth in claim 1 wherein said rigid members are metal plate stock bent to form said mounting flange and striker plate.

6. A striker assembly as set forth in claim 1 wherein said striker plates are secured to one another along said interior faces.

7. A striker assembly as set forth in claim 6 wherein said interior faces of said striker plates are brazened together.

8. A striker assembly as set forth in claim 1 wherein said striker plates are secured to one another by spot welding through said striker plates and brazening along said interior faces of said striker plates.

* * * * *